United States Patent [19]

van Heijst

[11] 4,280,238

[45] Jul. 28, 1981

[54] SINGLE-POINT MOORING BUOY

[75] Inventor: Willem J. van Heijst, Monte-Carlo, Monaco

[73] Assignee: Single Buoy Moorings, Inc., Fribourg, Switzerland

[21] Appl. No.: 58,729

[22] Filed: Jul. 18, 1979

Related U.S. Application Data

[63] Continuation of Ser. No. 850,056, Nov. 9, 1977, abandoned, which is a continuation-in-part of Ser. No. 688,738, May 21, 1976, abandoned.

[30] Foreign Application Priority Data

Sep. 3, 1975 [NL] Netherlands ..... 7510415
Dec. 24, 1975 [NL] Netherlands ..... 7515095

[51] Int. Cl.[3] ..... B63B 21/52; B63B 51/02

[52] U.S. Cl. ..... 9/8 R; 9/8 P; 114/230

[58] Field of Search ..... 9/8 R, 8 P, 8.3 R, 8.3 E; 114/230, 264–267

[56] References Cited

U.S. PATENT DOCUMENTS

| | | | |
|---|---|---|---|
| 52,522 | 2/1866 | Bowlsby | 9/8 R |
| 2,939,291 | 6/1960 | Schurman | 9/8 P |
| 3,092,852 | 6/1963 | Devereaux | 9/8 R |
| 3,390,408 | 7/1968 | Lockwood | 9/8 R |
| 3,572,408 | 3/1971 | Hnot | 114/230 |
| 3,641,602 | 2/1972 | Flory | 9/8 P |
| 3,667,239 | 6/1972 | Mott | 114/264 |
| 3,899,990 | 8/1975 | LeComte | 114/230 |

*Primary Examiner*—Trygve M. Blix
*Assistant Examiner*—D. W. Keen
*Attorney, Agent, or Firm*—Young & Thompson

[57] ABSTRACT

A single-point mooring buoy comprises a column which is hingedly connected to an anchor and upstands from the anchor and has a frequency less than six seconds. At the upper end of the column is pivotally connected to a fully submerged buoyant body which has a frequency or period of movement greater than 16 seconds. In this way, the loads on the various portions of the mooring buoy are held as low as possible and the buoy undergoes little movement in spite of wave action even in the presence of waves of high energy.

6 Claims, 6 Drawing Figures

SINGLE-POINT MOORING BUOY

Figure 1:
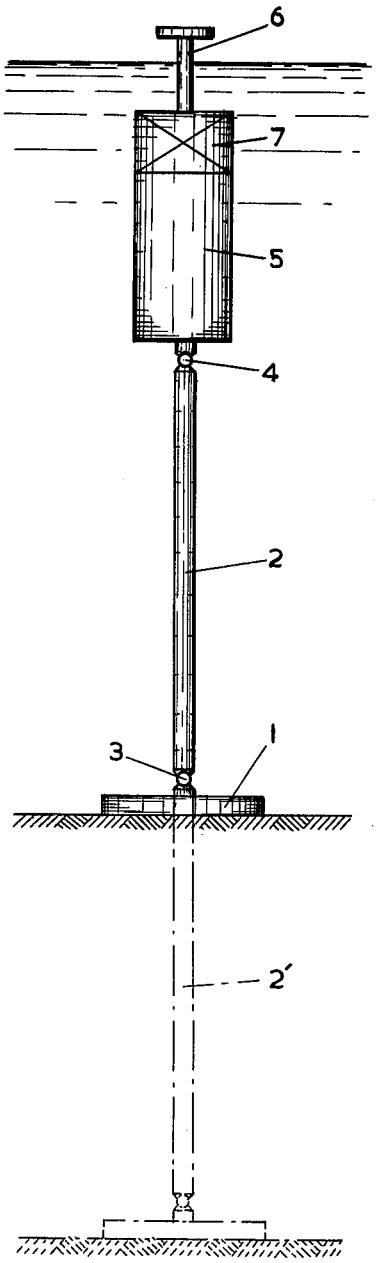

This is a continuation of application Ser. No. 850,056, iled Nov. 9, 1977, now abandoned, which is a continua- on-in-part of my copending application Ser. No. 88,738, filed May 21, 1976, now abandoned.

The invention relates to a single-point mooring buoy onsisting of a column having at least one rigid portion ingedly connected to an anchor and a buoy hingedly onnected to the upper end of said column, the body of vhich, having buoyancy, is principally below the water evel. An example of a similar buoy is disclosed in my J.S. application Ser. No. 687,755, filed May 19, 1976 ow U.S. Pat. No. 4,069,529. This buoy consists of a olumn which is coupled to an anchor by means of a ardan hinge, said column having at the upper end a ardan hinge which is connected to the body of the uoy, said body being principally under water and ex- ending above water in a portion having a small cross ection at the location of the water-line. Such a buoy is eld in place by the buoyancy of the body of the buoy nd eventually of the column, i.e. the buoy by means of ie buoyancy and the connection to the anchor will lways try to take a position which is directly above the nchor. Due to the force of currents, wind and wave ction, portions of the buoy may undergo a periodical iovement. If the column consists of a single portion ien this movement is a swinging movement around the owest hinge point whereby the body of the buoy per- orms a swinging movement as well as a translatory or ansverse movement, and the column also can undergo bending vibration.

The periods of these movements are defined by the iagnitude and the distribution of the mass and the dis- ibution of the dimensions of the buoyant column and ody. This distribution of the mass and dimensions, the uoyancy and the forces, exerted by currents, wind and vave action, determine the load upon the several parts vith the cardan hinges as critical points.

An object of the invention is to provide a buoy such iat these loads are held as low as possible.

According to the invention this object is achieved in iat the distribution of the mass and the distribution of ie dimensions of each rigid column portion are such iat the bending frequency of the column is less than 6 econds and the distribution of the mass and the distri- ution of the dimensions of the buoy are such that its eriod of movement is greater than 16 seconds. Further- iore mass and dimensions of the column should be such iat its period of movement is also greater than 16 sec- nds. Waves with high energy have a period which is reater than 6 seconds but less than 16 seconds. The iass and dimensions of the buoyant column and body re thus such that no resonance occurs.

The surprising effect is that a buoy is obtained which ndergoes little movement in spite of the wave action, ven as to waves having high energy; and as a result, the oads on the buoy and on the cardan hinges remain low, ven when a ship is moored at the buoy.

The column may consist of several portions, each aving a length short enough to keep the bending fre- uency under 6 seconds.

It may also be desirable to provide the buoyant body vith a ballast-space, which space for instance can be lled with water in order to increase the mass and thus ie period.

The invention now will be elucidated on the basis of the drawings, in which:

FIG. 1 schematically shows a buoy according to the invention, said buoy in principle corresponding to that disclosed in for instance the above-identified application.

Figure 2:
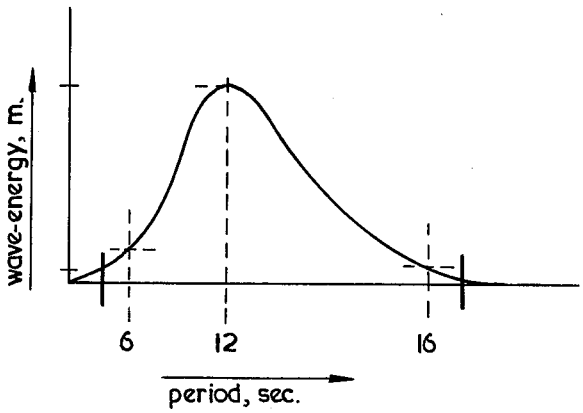

FIG. 2 shows a diagram in which wave energies are plotted against periods.

FIGS. 3*a* to 3*d* show the various vibration and/or movement possibilities.

The buoy shown in FIG. 1 consists of an anchor 1, a column 2, which by means of a cardan hinge 3 is connected to the anchor and by means of a cardan hinge 4 is connected to the body of the buoy 5, which is principally below the water level and by a slender standard 6 extends above the water level.

A conduit extending from the bottom to the top of the buoy can have revolving couplings or flexible hose portions at the location of the hinges through or along the column 2 and the body 5 of the buoy. An example of a similar connection is shown in the above-identified application.

In the illustrated example the column 2 has a length of about 100 m, the body 5 has a length of about 60 m and the standard 6 has a length of about 20 m.

FIG. 2 shows the relationship of the wave energy to the periods of the waves. From this it appears that waves with highest energy have a period of about 12 seconds, which period increases with decreasing wave energy but also decreases with lower wave energy. A wave with low energy will have a period below 6 seconds. This can be called a relatively short wave. From the diagram it appears, however, that there also are long waves, that is, waves with a very long period and low energy.

The relative masses of the buoy shown in FIG. 1 should be determined such that the mass of the column 2 has a period which lies at the left side of the 6 seconds ordinate in FIG. 2, whilst the body 5 should have such a mass that its period lies at the right side of the 16 seconds ordinate in FIG. 2.

If the length of the column portion 2 is such that its own frequency exceeds 6 seconds then this portion should consist of two portions as indicated with dotted lines at 2'.

A ballast space 7 can be filled with water in order to increase the mass of the body 5 and to alter the distribution of the mass.

Figure 3:
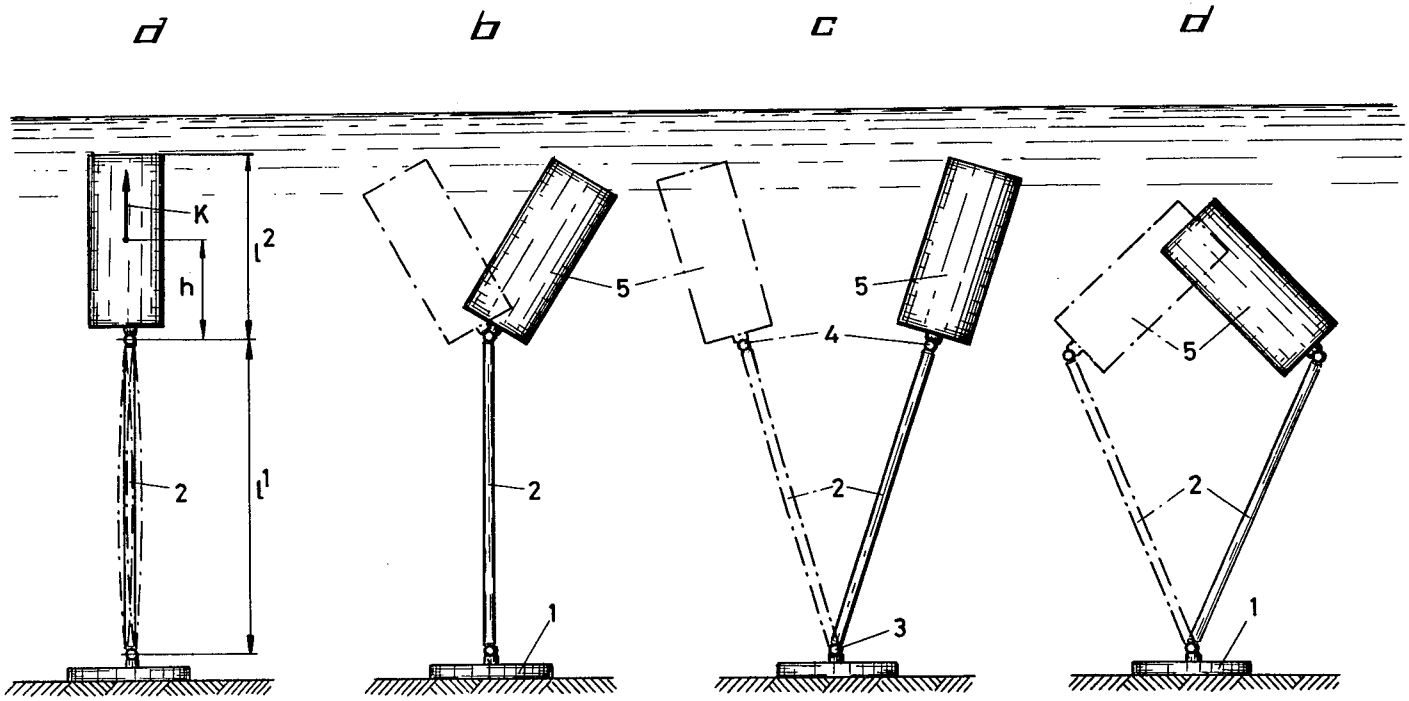

In FIG. 3 the different possibilities of movement and vibration are shown.

FIG. 3*a* indicates with interrupted lines the bending vibration which can occur in column 2.

FIG. 3*b* shows in which way the body 5 can swing around the hinge 4.

FIG. 3*c* shows the swinging to and fro of column 2 and body 5, together in the same direction.

FIG. 3*d* shows the swinging to and fro of column 2 and body 5 in opposite directions.

All portions are always completely immersed. The standard 6 has been left out in these Figures.

In the following Examples, the variables are defined as follows:

$\omega$ = vibration frequency in rad/sec.

c = spring constant.

I = moment of inertia.

$\rho$ = specific mass, that is, the weight per meter run.

$l^1$ = length of the column 2.

$l^2$ = length of the body 5.

K=the force exerted on the column by the body 5 or the buoyancy force.

dM=own mass+added mass; the added mass for a cylindrical cross section is equal to that of the displaced water.

$\mu$=own mass+added mass per meter run, that is, $\rho$+mass of water of the same volume per meter run.

h=the height of K to hinge 4.

d=diameter of column 2.

$d^1$=diameter of body 5.

r=half the diameter.

T=period.

s=column wall thickness.

The assumption on which the following calculations are based, is that a vibrating or swinging body under water behaves as though the moving unit were the body itself plus a body of water of the same volume as the volume of the solid body. This assumption is a standard assumption when performing computations of the type of those set forth in the present specification.

EXAMPLE I (see FIG. 3*a*)

The frequency of the column itself is:

I=moment of inertia of cross section of column $$\omega = \frac{\pi^2}{l^2}\sqrt{\frac{EI}{\mu}}$$

$E=2.1.10^4\ kg/mm^2 \times 10^6 = 2.1.10^{10}\ kg/cm^2$ $$I = \pi \cdot s \cdot r^3 = \frac{\pi \cdot s \cdot d^3}{8}$$

$$\omega = \frac{\pi^2}{l^2} \cdot \sqrt{\frac{2.1 \cdot 10^{10} \cdot \pi \cdot s \cdot d^3 \cdot 10}{8 \cdot \rho \cdot \frac{\pi}{4} d^2 \cdot 2}} = \frac{\pi^2}{l^2}\sqrt{0.54 \cdot 10^{10} \cdot \frac{s \cdot d}{\rho}} = \frac{\pi^2}{l^2}\sqrt{0.54 \cdot 10^8 \cdot 3 \cdot d}$$

The above calculation of omega exhibits the integer 10 at the end of the numerator and 2 at the end of the denominator. In this expression, 10 is a rounded-off value of 9.81, which is the metric constant corresponding to the acceleration of gravity, and is needed so as to convert mass to weight. The numeral 2 is the correction needed to add an equal volume of surrounding water to the volume of the oscillating body.

If 1=100 m, d=2.5 m and s=0.025 m, then:

$$\omega = \frac{\pi^2}{100^2}\sqrt{0.54 \cdot 10^8 \cdot 0.025 \cdot 2.5} = 1.81\ \text{rad/sec}$$

$$T = \frac{2\pi}{1.81} = 3.5\ \text{seconds.}$$

This is less than 6 seconds.

EXAMPLE II

For the column 2 with neutral buoyancy:

FIG. 3*c* without the buoy; so the column alone.

I=moment of inertia of swinging body, that is, the column swinging like an inverted pendulum c=K.1

$$I = \int_o^l r^2\, dM = \left[\frac{l^3}{3}\, dM\right]$$

$$dM = \left\{\frac{\pi}{4} d^2 \cdot \rho(dx)\right\} \cdot 2$$

$$I = \frac{\pi}{4} d^2 \times 2 \times \rho \times \frac{l^3}{3}$$

$$\omega^2 = \frac{c}{I} = \frac{6K}{\pi d^2 \cdot l^2 \cdot \rho}$$

$$T = 2\pi\sqrt{\frac{d^2 \cdot l^2 \cdot \rho}{6K}}$$

For $1^1$=100 m, d−2.5 m and K=250 tons T=23 seconds, which is far above the limit of 16 seconds. It is also clear that in case the buoy is connected to the column, the period of movement is still longer.

EXAMPLE III

If T is 20 seconds, then the question at which height h the buoyancy force K should act can be answered, when K=250 tons and $1^5$=45 m, and $d^1$=4 m, as follows:

$$T = 2\pi\sqrt{\frac{I}{c}}$$

$$1 > \frac{2\pi}{20}\sqrt{\frac{I}{c}}$$

$$1 > 0{,}1\,\frac{I}{c}$$

$$I = \frac{\pi}{4} d^2 \times 2 \times \rho \times \frac{l^3}{3} = \frac{\pi}{4} \cdot 4^2 \cdot 2 \cdot 100 \cdot \frac{45^3}{3}$$

$I \cong 76{,}340{,}000$ Kg-m $$1 > \frac{7{,}634{,}000}{c}$$

$c < 7{,}634{,}000 \quad c = K.h$ $K.h < 7{,}634{,}000$ $$h < \frac{7{,}634{,}000}{250{,}000} < 30.5\ \text{m}$$

What I claim:

1. Single-point mooring buoy comprising a column hingedly connected to an anchor and comprising at least one rigid column portion upstanding from the anchor and hingedly interconnected with the anchor and a buoyant body hingedly connected to the upper end of said column portion, the body being at least principally below the water level, the mass and the dimensions of each rigid column portion being such that its bending frequency is less than 6 seconds and its length is greater than the height of the buoyant body, and the mass and the dimensions of the buoyant body being such that its period of movement is greater than 16 seconds, the dimensions of each said column portion being such that its period of movement is greater than 16 seconds, said bending frequency less than 6 seconds and said periods of movement greater than 16 seconds being so different from the frequency of about 12 seconds of waves of highest energy, that the buoy undergoes little movement under wave action, whereby the loads on the buoy and portion and the anchor remain low even when a ship is moored at the buoy.

2. A buoy as claimed in claim 1, said buoyant body being fully submerged, and a slender standard extending from said buoyant body above the water level.

3. A buoy as claimed in claim 1, in which the buoyant body has a ballast space therein.

4. A buoy as claimed in claim 1, in which there are a plurality of rigid column portions each having a frequency less than six seconds.

5. A buoy as claimed in claim 1, in which said rigid column portion comprises a slender rigid column extending from said anchor to the lower end of said buoyant body, said buoyant body being vertically elongated and of a thickness substantially greater than the thickness of said rigid column.

6. A buoy as claimed in claim 5, said buoyant body being fully submerged, and a slender standard extending from said buoyant body above the water level.

* * * * *